United States Patent [19]

Hodgson

[11] 4,132,583

[45] Jan. 2, 1979

[54] LABEL APPLICATOR

[75] Inventor: William S. Hodgson, Hingham, Mass.

[73] Assignee: South Shore Machine Company, Inc., Braintree, Mass.

[21] Appl. No.: 887,549

[22] Filed: Mar. 17, 1978

Related U.S. Application Data

[63] Continuation of Ser. No. 733,222, Oct. 18, 1976, abandoned, which is a continuation cf Ser. No. 533,503, Feb. 21, 1975, abandoned.

[51] Int. Cl.[2] ..... B44C 1/00; B65C 9/14

[52] U.S. Cl. ..... 156/351; 156/361; 156/493; 156/542; 156/DIG. 33; 156/DIG. 42

[58] Field of Search ..... 152/542, 541, 540, 361, 152/351, 571, 581, DIG. 42, DIG. 33, DIG. 16–17, 580, 584, 562, 493; 221/73; 226/23, 45; 271/256, 258

[56] References Cited

U.S. PATENT DOCUMENTS

| | | | |
|---|---|---|---|
| 2,232,729 | 2/1941 | Randolph | 156/317 |
| 3,527,382 | 9/1970 | Knoll | 156/584 |
| 3,729,362 | 4/1973 | French et al. | 156/542 |
| 3,736,208 | 5/1973 | Kraft et al. | 156/541 |
| 3,823,050 | 7/1974 | La Mers | 156/566 |
| 3,888,724 | 6/1975 | Spannknebel et al. | 156/542 |

*Primary Examiner*—Michael W. Ball
*Attorney, Agent, or Firm*—Cesari and McKenna

[57] ABSTRACT

An applicator automatically applies strip-mounted labels very precisely to both flat and curved objects. As each object is brought into position, a special pressure foot immediately applies a label already positioned on the foot to the object and the foot is designed to press the label against the object over the entire area of the label. As each object moves out of position, the label strip is advanced over a stripper plate by a preset amount as determined by an inductive label edge sensor. Simultaneously with this, the pressure foot momentarily swings toward the stripper plate and picks up the next label being peeled from the strip to ready the applicator for the next cycle.

7 Claims, 9 Drawing Figures

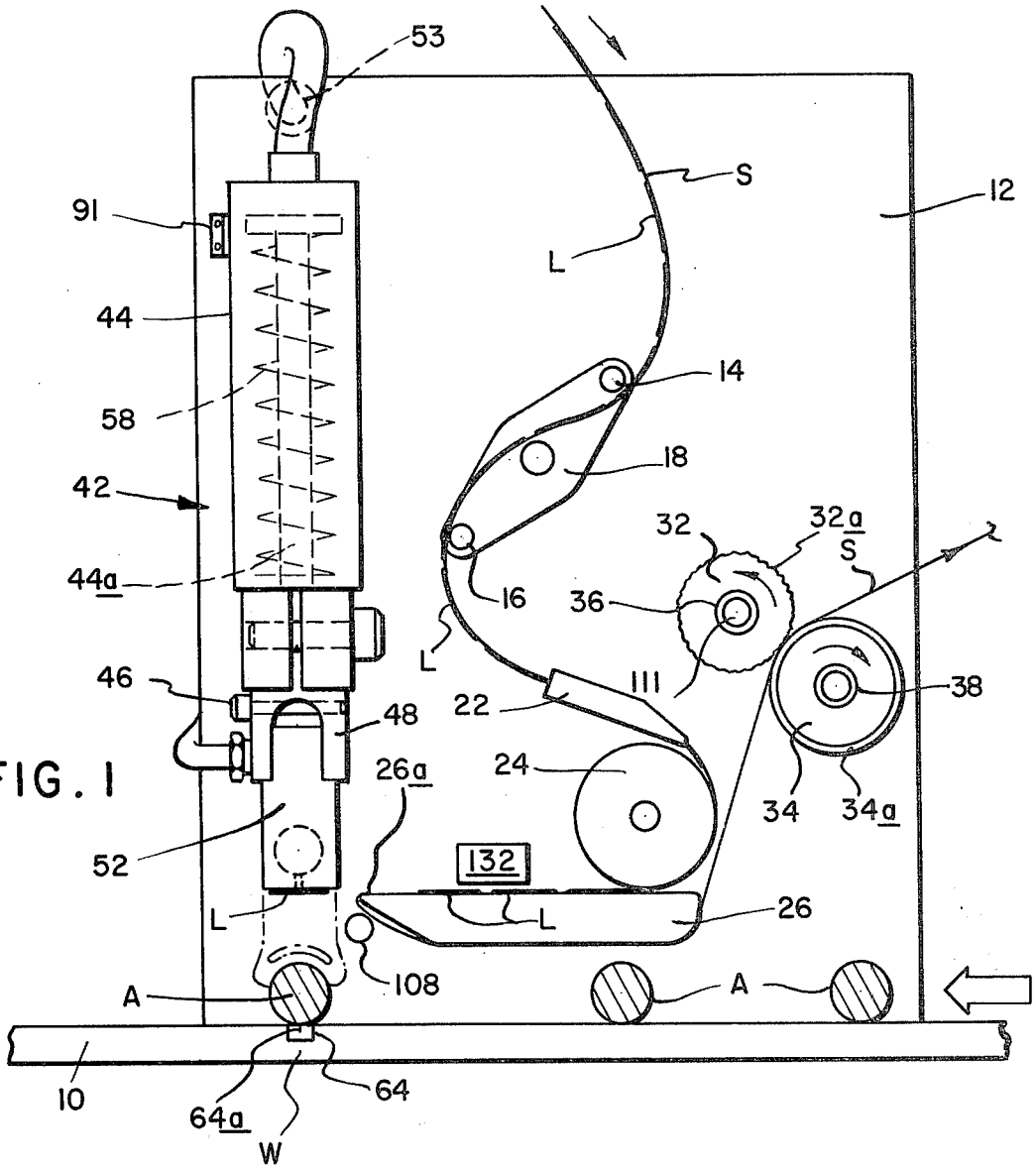
FIG. 1
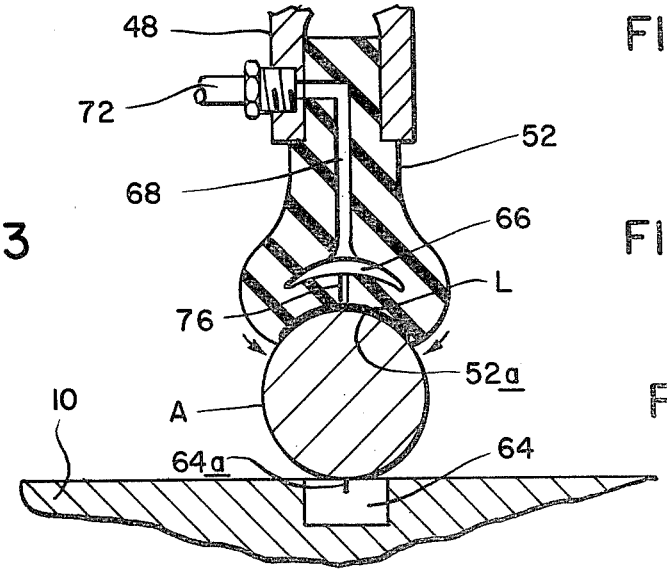
FIG. 3
FIG. 7A
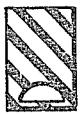
FIG. 7B
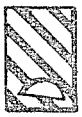
FIG. 7C
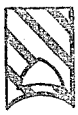

LABEL APPLICATOR

This is a continuation of application Ser. No. 733,222 filed Oct. 18, 1976, now abandoned, which is a continuation of Ser. No. 533,503, Feb. 21, 1975, abandoned.

BACKGROUND OF THE INVENTION

This invention relates to a label applicator. It relates more particularly to an applicator which strips labels successively from a tape and automatically applies them to successive objects.

There are many different types of label applicators is use today. Often, the labels to be applied are adhered to a backing strip or tape which is wound into a roll. The applicator advances the strip over the knife edge of a stripper plate. The label, being somewhat stiff, tends to remain flat and continue in the same direction so that it peels from the strip.

Many prior applicators also have an extensible pressure foot which picks up the label as it separates from the strip and presses it down against an object. When the next object is brought into position, the strip is advanced by a predetermined amount to bring the next label into position to be picked up by the pressure foot. Examples of such applicators are shown in U.S. Pat. Nos. 3,450,590; 2,489,837; 3,736,208; 3,769,139; 3,405,021 and 3,436,294.

Prior label applicators of this general type are not entirely satisfactory for a variety of reasons. Some are not able to properly apply a label to an article which is relatively sharply curved in one or more directions, such as a pen or paint brush handle, for example. While the middle of the label adheres to the article, its edges do not, with the result that they catch on something and are pulled away from the pen or handle.

Other conventional applicators do not position the label accurately enough on the article. This becomes a problem if the article or package has a particular spot especially designed to receive the label. Only a few thousandths of an inch error may cause the label to cover advertising matter on the article or overhang one of its edges or otherwise disfigure the article.

The major reason for the inability of the prior applicators to properly position the label is due to the fact that they do not control the advance of the label strip accurately enough to properly position successive labels for application to successive articles. Some rely on photoelectric devices to stop the advance when they detect each label. However, position errors arise if the colors of the labels and backing strip are too similar and, in the case of labels which are more or less transparent, this type of applicator cannot be used at all. Other label applicators use mechanical devices such as a spring-like finger or star wheel sensor to detect the leading edges of successive labels to control tape advance. However, position errors arise there because the label thickness may vary so that the leading edges of some labels are not sensed. Faulty operation will also occur with labels that are too thin.

Other applicators of this type are disadvantaged because they are excessively complicated, bulky or expensive.

SUMMARY OF THE INVENTION

Accordingly, the present invention aims to provide a label applicator which applies labels properly and securely to both flat and sharply rounded articles.

Another object of the invention is to provide an applicator of this type which applies labels to articles very accurately on a continuous basis.

A further object of the invention is to provide a label applicator which can operate for a relatively long time with minimum maintenance.

Yet another object of the invention is to provide a label applicator which is relatively small and compact.

A further object of the invention is to provide a label applicator which is relatively inexpensive to make and maintain.

A further object of the invention is to provide a label applicator which is insensitive to label and backing strip color.

Still another object of the invention is to provide a label applicator which is insensitive to label thickness and spacing on the backing strip.

Other objects will in part be obvious and will in part appear hereinafter.

The invention accordingly comprises the features of construction, combination of elements and arrangement of parts which will be exemplified in the construction hereinafter set forth and the scope of the invention will be indicated in the claims.

Briefly, the present applicator draws on labels spaced apart along a backing strip wound onto a roll. The label carrying strip is advanced over a stripper plate in incremental fashion so that successive labels are stripped away from the backing strip in the usual way. The length of backing strip devoid of labels passes through the nip between a driven feed roll and a pinch roll and is then wound up on a takeup reel or is otherwise disposed of.

A reciprocable applicator is positioned adjacent the stripper plate. As the label strip is advanced around the stripper plate, the applicator tilts momentarily so that a special resilient foot thereon, to be described later, is positioned closely adjacent the label being peeled from the strip. The foot is hollow and openings are provided in its wall facing the label so that, when a vacuum is drawn in the foot, the label is picked up by and adheres to the foot as it leaves the backing strip. Since the foot is positioned quite closely to the label and picks up the label as it peels away from the backing strip, the label is positioned quite accurately on the foot.

When the applicator returns to its rest or ready position with the stripped-away label adhered to its foot, the machine is ready to apply the label to an article positioned directly below the foot.

As soon as an article such as a paint brush, for example, is moved into position below the foot, the applicator immediately moves downward so that its foot presses the label against the article. Thus, there is no delay while the applicator foot picks up a label, as is the case with many conventional machines of this type.

The applicator foot has a cavity in it and a plurality of small passages extend through the bottom wall of the foot into the cavity. An additional passage extending from the cavity is connected to a source of negative pressure.

When the foot is driven down against an object, the foot is compressed somewhat so that its bottom wall applies a firm, even pressure against the article. If the article is rounded in either one or more directions, the foot deforms so that its bottom wall conforms to the article.

More particularly, as the foot engages the article, the central portion of the bottom wall is deflected upward by the article into the cavity in the foot so that the edge margins of the bottom wall are drawn toward one another with the result that the foot applies pressure even to the side of a cylindrical, spherical or other rounded article. Thus a label positioned on the foot is pressed against the article over its entire area so that even its edge margins extending around the sides of the article by as much as ninety degrees are firmly adhered to the article.

After the applicator and its foot retract, leaving the label firmly attached to the article, the article is moved out of the station. This actuates the feed roll to advance the label strip so that the next succeeding label is peeled from the strip at the stripper plate and picked up by the applicator which momentarily tilts to meet the label as described above. During this time, also, the next article is being fed into position below the applicator. Before it reaches position, the applicator has returned to its upright position with the next label attached to its foot so that the apparatus is ready for the next cycle of operation.

The extent to which the feed roll is turned to advance the label strip is precisely controlled by a unique inductive type of sensor which detects the edge of each successive label on the strip. The sensor is extremely sensitive so that it responds to the leading edges of even very thin labels and variations in label thickness do not present any problem either. The sensor and the related control circuitry will be described in greater detail later.

Thus, the subject label applicator is able to position labels of many different sizes very accurately, i.e. within 0.003 inch. Furthermore, it positions labels with accuracy on a very consistent basis. The applicator can also apply labels properly and consistently to articles having a variety of shapes, including cylindrical, polygonal and even spherical configurations. Yet, with all of these advantages, the apparatus is quite compact, simple to operate and easy to maintain.

BRIEF DESCRIPTION OF THE DRAWINGS

For a fuller understanding of the nature and objects of the invention, reference should be had to the following detailed description taken in connection with the accompanying drawings, in which:

FIG. 1 is a diagrammatic view showing the label applicator in front elevation;

FIG. 3 is a sectional view with parts in elevation on an intermediate scale showing the applicator foot in operation;

FIGS. 7A to 7C illustrate alternative applicator foot configurations.

DESCRIPTION OF THE PREFERRED EMBODIMENT

Figure 2:
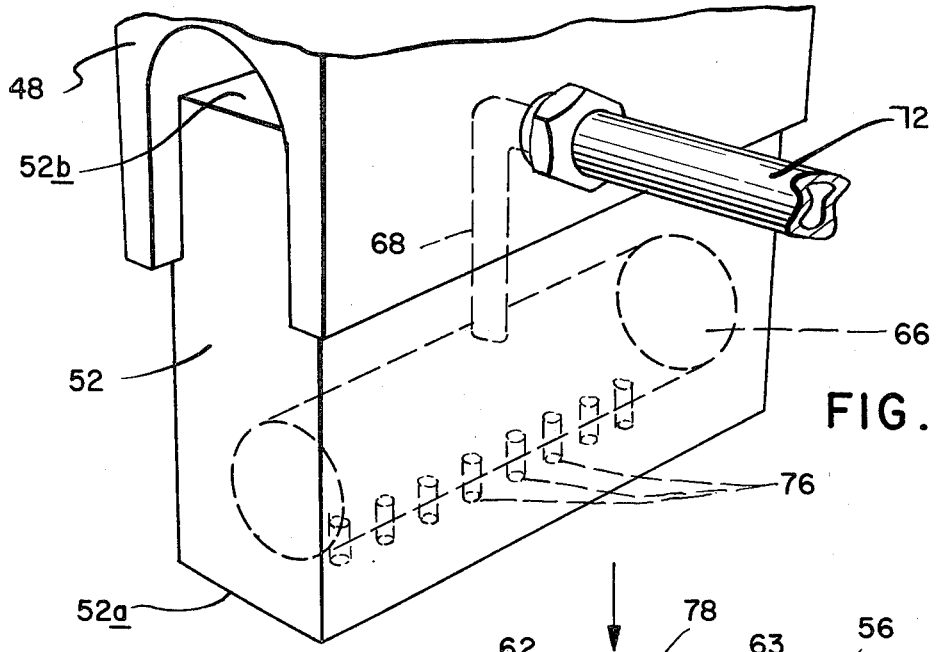
FIG. 2 is a fragmentary perspective view on a larger scale showing the applicator pressure foot in greater detail.

Referring now to FIG. 1 of the drawings, the label applicator comprises a base 10 supporting an upstanding panel 12 which supports most of the applicator's component parts. Labels L are releasably adhered to a backing strip S drawn from a roll (not shown). The label L are spaced apart along the backing strip which is provided with a release coating so that the labels can be stripped away relatively easily.

The strip is trained under and over a pair of horizontally extending guide bars 14 and 16, respectively, which are mounted on a yoke 18 secured to panel 12. Thence, the strip passes through a guide 22 which is secured to panel 12 which controls the lateral positioning of the strip. Just below guide 22 is a freewheeling infeed roll 24 rotatively mounted to panel 12 around which the strip carrying the labels L passes on its way to a stripper plate 26 suspended horizontally from panel 12. The leading end of the strip devoid of labels passes over the stripper plate knife edge **26*a* and under the stripper plate itself. Then the strip is conducted through the nip between a driven feed roll 32 and a pinch roll 34, both rotatively mounted on panel 12**, and thence to a suitable takeup reel (not shown).

The feed roll 32 has a knurled surface **32*a* and the pinch roll 34 has a resilient surface 34*a* so that the strip S is firmly gripped between the two rolls. Also, both rolls 32 and 34 are outfitted with one-way clutches 36 and 38**, respectively, so that they can only turn in the directions indicated by the arrows thereon to pull the tape through the applicator.

Feed roll 32 is driven in the direction indicated by its arrow so as to pull the tape S across the top of the stripper plate. As the relatively flexible backing strip S is pulled over the knife edge **26*a***, the label L thereon, being somewhat stiffer, does not bend around the knife edge. Rather, it continues moving in the horizontal direction so that it is gradually peeled from the backing strip in a manner which is quite well-known in the art.

Still referring to FIG. 1, an applicator shown generally at 42 is connected to a shaft 43 (FIGS. 4 and 5) rotatively mounted in panel 12 just to the left of the stripper plate knife edge **26*a*. Applicator 42 includes a pneumatic cylinder 44 and a piston rod 44*a*. Clamped to the piston rod by a set screw 46 is a hollow, generally rectangular support 48 which is open at the bottom. A generally rectangular pressure foot 52** is pressfit into the bottom of the support.

Figure 4:
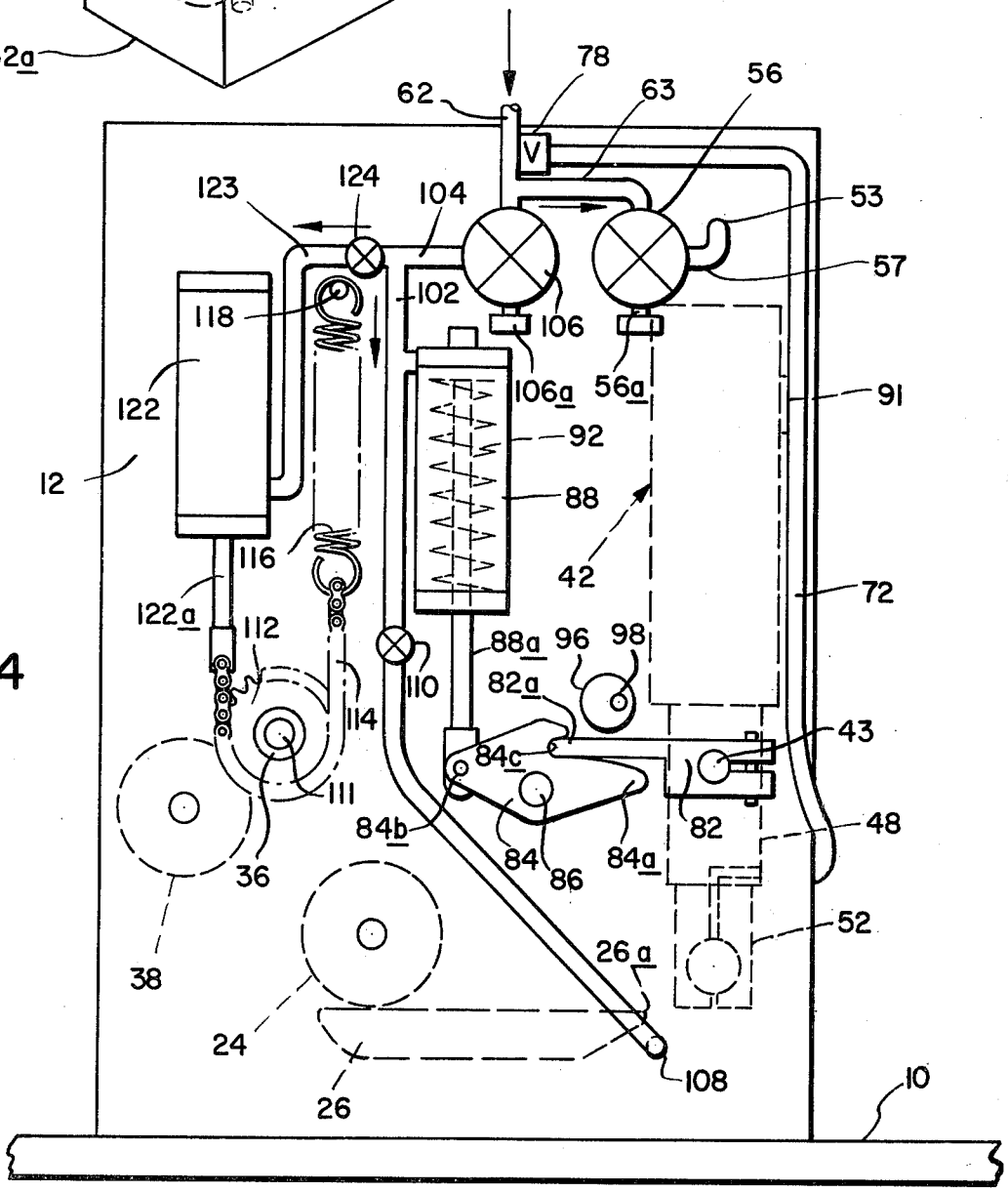
FIG. 4 is a view similar to FIG. 1 showing the applicator in rear elevation.

As best seen in FIGS. 1 and 4, a hose 53 connects the cylinder to a solenoid-operated valve 56 which is, in turn, connected by hose lines 62 and 63 to a suitable compressed air source (not shown). When valve 56 is energized momentarily, air enters cylinder 44 so that the piston rod **44*a*, together with support 48 and the pressure foot 52, are driven downward momentarily from their solid line position shown in FIG. 1 to a position well below stripper plate 26** as shown in dotted lines in that figure.

The applicator 42 is actuated when an article A to which a label is to be applied is positioned at a work station W directly below foot 52. The article A may be a paint brush handle, a golf ball, a pencil, a box or most any other flat or curved article. Furthermore, a succession of articles A can be advanced into work station W, say, from right to left as shown by the arrow, using any conventional indexing or conveyor mechanism.

Suffice it to say that when an article reaches the work station W, a conventional switch 64 or other comparable means is actuated. Of course, the articles A may be fed to station W automatically from any other direction or they may be positioned there manually by an operator.

As soon as the valve 56 is de-energized, the air in cylinder 44 is vented to the atmosphere through exhaust port 56*a* in valve 56 and the piston 44*a* and foot 52 are retracted to their upper solid line position shown in FIG. 1 by a spring 58 inside cylinder 44.

Referring now to FIG. 2, the pressure foot 52 secured in support 48 comprises a generally rectangular block of a suitable sturdy, flexible and resilient material. The foot has a generally cylindrical cavity or bore 66 extending almost the entire length of the foot near its bottom wall 52*a*. The cavity may be formed by drilling through the block from one side wall almost to the opposite side wall and then plugging or otherwise closing off the opening in the one side wall. Alternatively, the block may be molded or cast with the cavity in it. A vertical passage 68 is formed in the foot which extends from its top wall 52*b* to cavity 66. A vacuum hose 72 extending through a suitable opening in the side of support 48 communicates with passage 68. Finally, a series of relatively small passages 76 extend in from the lower wall 52*a* to cavity 66. These openings 76 are distributed along the length of the bottom wall.

As best seen in FIG. 4, hose 72 is connected to a Venturi 78 appropriately installed in the air supply hose 62 so that a vacuum is drawn in hose 72. If desired, a conventional vacuum pump or other vacuum source may be used for this purpose. That suction is obviously present at the mouth of each passage 76 in the foot wall 52*a* so that a label L placed just under the foot tends to adhere to wall 52*a*. It is apparent then that no separate vacuum source is necessarily needed with this equipment.

Referring now to FIG. 3, when the valve 56 is energized, foot 52 carrying label L is driven downward against an article A, the foot deforms so that the bottom wall 52*a* and the label adhered to that wall conform to the surface of article A as shown in FIG. 3. More particularly, the central portions of bottom wall 52*a* are driven upward by article A so that this wall collapses into cavity 66, with the result that the edge margins of the bottom wall are pulled toward one another as indicated by the arrows in that figure so that forces are applied even to the sides of article A. Consequently, the entire area, and especially the edges, of label L is pressed firmly against the surface of article A. Thus, there are no unattached label edges which, at the very least, are unsightly and, at worst, can catch on something and cause the label to be stripped from the article.

The specially configured foot 52 is able to deform so as to conform to a variety of different rounded objects such as pencils, pens, handles on tools of various kinds, etc. Also, it is obvious that it is also contemplated here to have a pair of cavities 66 in a generally square block 52 at right angles to one another so that the foot will conform in the same manner to spherical objects such as balls which curve by the same amount in two directions.

Turning now to FIGS. 1 and 4, the present label applicator includes provision for assuring that successive labels L automatically applied to successive articles A are all precisely positioned on each article within an accuracy as high as 0.003 inch. More particularly, the shaft 43 rotatively supporting the applicator 42 on panel 12 extends through the panel and a lever arm 82 is secured to the end of the shaft behind the panel with its end 82*a* being spaced appreciably from shaft 43.

A locking cam 84 is connected by pivot 86 to panel 12, with the pivot being located just to the left and below the lever arm end 82*a*. One end 84*a* of the cam extends under lever arm 82, while its other end 84*b* is pivotally connected to a piston rod 88*a* projecting down vertically from a pneumatic cylinder 88 secured to panel 12.

When piston rod 88*a* is in its fully retracted position shown in FIG. 4, an ear 84*c* formed in the top of cam 84 engages over the end 82*a* of the lever arm so as to maintain the lever arm in a generally horizontal plane. This orientation maintains the applicator 42 in an upright position. The piston rod is normally maintained in this retracted position by a coil spring 92 inside cylinder 88.

On the other hand, when piston rod 88*a* is extended, cam 84 pivots counterclockwise, thereby swinging ear 84*c* away from the end of the lever arm 82*a*. Cam end 84*a* engages the underside of arm 82 and moves the lever arm in a clockwise direction as viewed in FIG. 4. The length of the arc through which cylinder 44 can rotate is limited or adjusted by means of a suitable stop. Illustratively, an eccentric 96 is secured by an adjusting stud 98 to panel 12 just above the lever arm 82 so that lever arm 82 is pinched between the underside of eccentric 96 and the upper surface of cam end 84*a*.

Cylinder 88 is connected by hoses 102 and 104 to a solenoid-actuated valve 106. The valve, in turn, receives compressed air from the hose 62. When the valve 106 is energized, air is delivered to the cylinder, causing the piston rod 88*a* to extend, thereby tilting the applicator 42 to its solid line position shown in FIG. 5. A spring 91 is mounted on frame 12 adjacent cylinder 88 which engages the cylinder in this position and biases it toward its original rest position. When the valve 106 is de-energized, the air cylinder 88 exhausts through an exhaust port 106*a* on valve 106, allowing the spring 92 to retract the piston rod 88*a* and the applicator 42 is returned to its rest position shown in dotted lines in FIG. 5 by spring 91.

Figure 5:
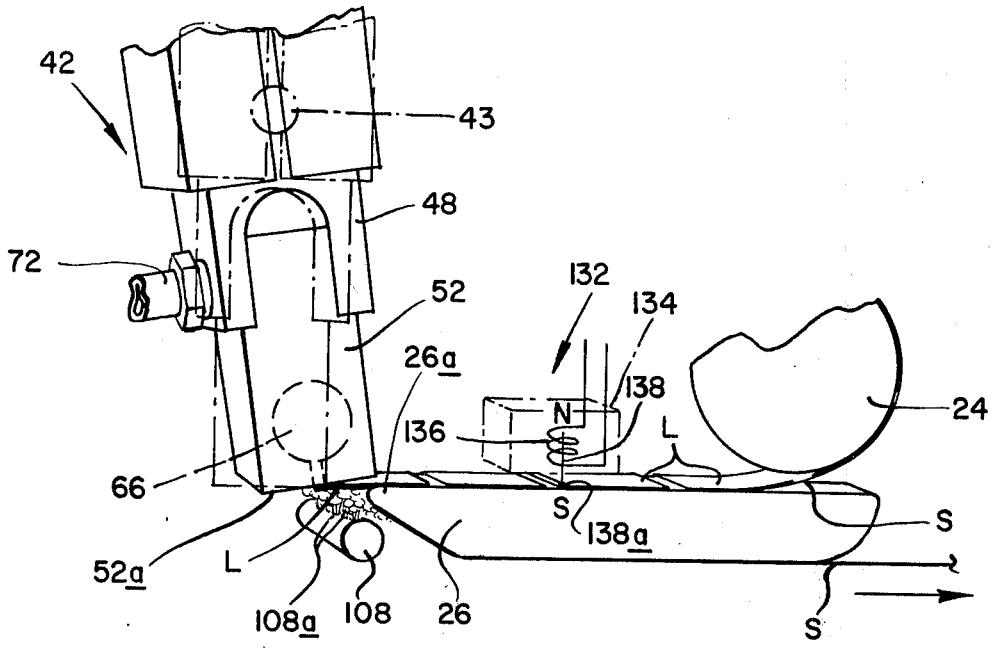
FIG. 5 is a fragmentary elevational view illustrating the operation of a part of the applicator.

Referring to FIGS. 4 and 5, and also to FIG. 1, the hose 102 also communicates with a puffer tube 108 supported by panel 12 just below the stripper plate knife edge 26*a*. The tube 108 is oriented parallel to the knife edge and has a lengthwise series of holes 108*a* so that when valve 106 is actuated, air jets issue upwards from openings 108*a*. These jets assure that the labels are in contact with surface 52*a* during stripping. A manual valve 110 in hose 102 downstream from cylinder 88 allows one to adjust the strength of these air jets.

Referring particularly to FIG. 4, when the applicator 42 swings over toward the stripper plate as described above, the label strip is advanced to position a label at the knife edge 26*a* where the label is peeled away from the strip and picked up by the applicator's pressure foot 52. The advance of the strip is carefully controlled so that the label is precisely positioned on the underside of the foot. More particularly, the shaft 111 which provides the input via the one-way clutch 36 to roll 32 (FIG. 1) is rotatively supported in panel 12 with its end projecting through that panel.

A sprocket 112 is connected to the end of that shaft behind the panel and a chain 114 is trained around the sprocket. One end of the chain is connected to one end of a vertically oriented coil spring 116 whose opposite end is secured by a pin 118 to the panel 12. The other end of chain 114 is pivotally connected to a piston rod 112*a* projecting down from a vertically oriented pneumatic cylinder 122 secured to panel 12.

Normally, the piston rod 122*a* is maintained in its fully extended position by spring 116 pulling downward on the rod by way of chain 114. Of course, the spring also applies a torque to gear 112, tending to rotate it in a counterclockwise direction which is also the direction of slip in the one-way clutch 36.

When valve 106 is energized, compressed air is conducted to cylinder 122 by means of a hose 123 connected via valve 124 to hose 104. This retracts the piston rod 122*a*, thereby rotating gear 112 in a clockwise direction in FIG. 4 (counterclockwise in FIG. 1) in opposition to the spring 116 bias. The gear, acting through the one-way clutch 36, thereupon turns the feed roll 32 in a counterclockwise direction as viewed in FIG. 1, thus advancing strips S in the indicated direction. The speed at which piston rod 122*a* retracts and feed roll 32 turns can be controlled by adjusting the valve 124.

The stroke of piston rod 122*a* and thus the angle through which feed roll 32 rotates is determined by the one-time of the valve 106. The longer the valve is open, the longer the feed roll 32 will turn and the farther the strip S will advance across the stripper plate 26. Of course, the on-time of valve 106 also determines the length of time that the applicator 42 is cocked as described above. Thus, applicator swingover, label puffing and strip feed all function simultaneously.

Figure 6:
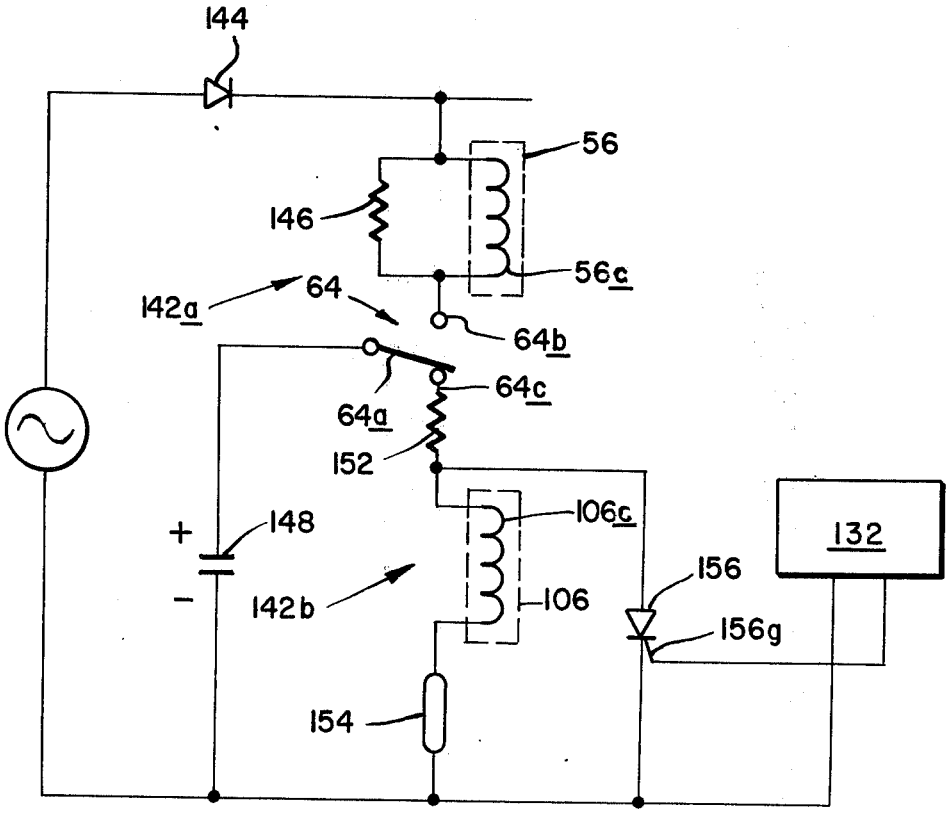
FIG. 6 is a schematic diagram showing the applicator control system in detail.

Turning now to FIGS. 5 and 6, after valve coil 106*a* energized to advance the strip S, a detector 132 positioned just above the stripper plate 26 senses the leading edge of an advancing label L and shuts off valve 106. Thus, the strip S is advanced by an amount which is precisely equal to the width of a label L plus the width of the gap between adjacent labels on the strip. The advance is just enough to peel the label L at the knife edge 26*a* from the strip S and position its leading edge directly below a line along the left-hand edge margin of the "swung-over" pressure foot 52 as viewed in FIG. 5. Also, the releasing label is blown against the underside of the foot 52 by the air jets issuing from puffer tube 108 and held against the foot bottom wall 52*a* by the suction developed at the passages 76 (FIG. 2) in that wall.

Each successive label L stripped from the backing strip S is precisely positioned in register against the underside of the pressure foot 52 so that when the pressure foot is driven downward against an article A as shown in FIG. 3, it deposits the label L at precisely the same location on the surface of each successive article. The subject apparatus is easily able to hold the label position tolerance to within 0.003 inch or better even when the article A is sharply rounded.

As seen in FIG. 5, detector 132 is comprised of a housing 134 containing a vertically oriented induction coil 136. A pin-like magnet 138 is mounted for vertical movement along the axis of coil 136. The lower end 138*a* of the pin projects out through a suitable opening in the bottom of housing 134 and rides along the top of strip A. It is held to the top surface of the strip or labels by the magnetic attraction provided by the steel stripper plate 26.

Assuming the magnet 138 is resting on the backing strip S between adjacent labels L, when the strip is advanced to bring the leading edge of the next label L opposite the magnet, the magnet is shifted upwards as it rides up onto the label. This generates a current pulse in coil 136 which initiates shutoff of valve 106 (FIG. 4). The detector 132 is preferably mounted on plate 26 and is laterally adjustable relative to the plate to compensate for labels of different width.

The detector 132 is extremely sensitive so that it is able to sense the leading edges of labels even though their thickness may vary along strip S and from strip to strip. Furthermore, it is extremely accurate since its tip 138*a* senses the precise instant in time when a label passes the detector, unlike some prior sensors used for this purpose which rely on a light beam or a spring finger or star wheel which have a larger sensing "window". Also, the illustrated inductive sensor is completely insensitive to the colors of the labels L and strip S, unlike comparable optical detection devices.

Turn now to FIG. 6 which shows the major components of the label applicator's control system. The applicator receives its power from a conventional a.c. source. The control system includes two circuits 142*a* and 142*b* on either side of the double throw switch 64. These circuits work alternately as determined by the position of the switch and, in conjunction with energy storage cap 148, circuit 142*a* comprises a series circuit consisting of a diode 144 which rectifies the a.c. power, a charging resistor 146 in parallel with the valve coil 56*c* and the switch contact 64*b*.

The circuit 142*b* consists of switch contact 64*c*, a resistor 152, the coil 106*c* of valve 106 and an adjustable time delay 154. Also, a silicon-controlled rectifier 156 is connected across coil 106*c* and delay 154, with the rectifier gate terminal 156*g* being connected to receive the output pulses from detector 132.

Normally, the movable switch contact 64*a* is in the position illustrated in FIG. 6. When an article A is indexed into the work section W, contact 64*a* is urged against switch contact 64*b* so that energy storage capacitor 148 commences charging through resistor 146 and coil 56*a*. The portion of the charging current flowing through coil 56*a* opens the valve 56, thereby driving the applicator foot 52 to which a label L has already been applied down against article A so that the article holds switch 64 in this position.

As soon as the capacitor 148 is fully charged, current ceases to flow in coil 56*c*, whereupon valve 56 is closed and foot 52 is retracted from article A by spring 58 (FIG. 1). Thereupon, article A is indexed out of the work station W or removed therefrom manually so that the switch contact 64*a* returns to its normal position shown in FIG. 6 so that capacitor 148 applies voltage through solenoid valve coil 106*c* to the time delay 154. The delay 154 provides a short delay, e.g. 1/10 to 1/20 second, before completing circuit to and applying current to the coil 106*c* in order to allow time for the pressure foot 52 to return to its upper position.

As soon as valve 106 opens, the feed roll 32 advances the label strip S so that the label closest to the stripper plate knife edge 26*a* is peeled from the strip. Simultaneous with this, air jets issue from puffer tube 108 to help support the detaching label and piston rod 88*a* extends to cock applicator 42 so that its pressure foot 52 swings over to meet the detaching label. Feed roll 32 continues turning until the leading edge of a label L encounters the pin magnet 138. The magnet is then shifted within the coil 136 so that a current pulse is induced in the coil which is applied to the gate terminal 156*g* of rectifier 156. The rectifier fires and short-circuits coil 106*c*, with the result that the valve 106 is closed.

As soon as valve 106 closes, the air jets from puffer tube 108 cease and cylinder 88 is vented to the atmosphere so that its piston rod 88*a* retracts. This causes the applicator 42 to return to its upright position by spring 91 whereupon it is locked by cam 84. Also, cylinder 122 is vented to the atmosphere so that gear 112 is rotated counterclockwise, reading the feed roll clutch 36 for the next cycle which is initiated when the next article A reaches the work station W and actuates switch 64.

At this point, the leading edge of a label L is positioned right at the pin magnet 138. Consequently, during the next cycle, the applicator will advance strip S so that the leading edge of the next label is brought under pin magnet 138. This strip travel is just enough to place the leading edge of the label being peeled from strip S at the proper position on the bottom wall of the pressure foot 52. This precise placement of the detaching label on the pressure foot which has swung over quite close to meet the label contributes substantially to the high label position accuracy enjoyed by this applicator.

As seen from the foregoing, the applicator can operate on a conventional current supply and a compressed air source which is normally found in many plants and factories. The pressure force also provides the vacuum requirements of the machine by way of the Venturi 78 (FIG. 4). Therefore, no separate vacuum source is required. The label applicator is also quite small and compact. Furthermore, it is easy to operate and maintain so that its operating costs should be minimal. Yet, it is quite versatile in that it can apply labels of varying size and thickness with equal accuracy to objects of many different shapes.

Any label applicator may have to be positioned in a production line with the applicator foot 52 positioned toward the left as illustrated in FIG. 1, or the foot may have to face in the opposite direction, i.e. toward the right in FIG. 1. The present applicator can easily be altered to suit either of these two arrangements.

More particularly, all of the components of the applicator are mounted in various openings in frame 12. Therefore, to convert the applicator from the left-hand setup shown in FIG. 1 to a right-hand arrangement, one simply removes the various components from the front face of frame 12 and replaces them in the very same openings, but at the rear face of the frame. Then the entire applicator is turned around so that the foot 52 would now be situated at the right side of FIG. 1 and the roll 32 would be positioned at the left side of that figure.

The applicator foot 52 may assume a variety of configurations depending upon the particular application. The rectangular foot with its cylindrical cavity illustrated in FIG. 1 is best suited for applying labels to generally cylindrical articles such as paintbrush handles, pencils, pens, etc. Other article shapes may call for other foot configurations. FIGS. 7A to 7C show three different applicator feet in section.

In FIG. 7A, the cavity in the foot has a generally semicircular cross section with the flat wall of the cavity being parallel to the foot bottom wall. When this foot is pressed down against a rounded object, the edge margins of the foot bottom wall apply an especially strong pressure against the sides of the object.

FIG. 7B shows an applicator foot in which the semicircular cavity is cocked slightly so that the flat wall of the cavity is skewed relative to the foot bottom wall. When this foot is pressed against a rounded object, the left-hand edge margin of the foot applies a greater pressure to the object than does the right-hand foot edge margin. This type of foot may be used where the object is not symmetrical or where, for one reason or another, more foot pressure is desired at one side of the object than the other.

FIG. 7C shows an applicator foot having a concave bottom wall and a cavity whose cross section is "shield-shaped". In other words, the bottom wall of the cavity curves in conformance with the foot bottom wall and the cavity side walls are arcuate. Foot configurations such as this should be able to apply pressure even against the sides of an object having a square or rectangular cross section. It can also be used to stretch a label as it is being applies to a first article since the edge margins of the foot would tend to spread apart in this case.

Of course, the applicator feet shown here can be used in other situations where it is desired to apply pressure against variously shaped objects. For example, the foot may be used to apply pressure against the sides of a deformable tube having a lengthwise slit in order to squeeze the tubes sufficiently to close the slit. In another application, the foot may be used to shape a soft body of material such as clay, plastic or the like.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative an not in a limiting sense.

It is also to be understood that the following claims are intended to cover all of the generic and specific features of the invention herein described.

I claim:

1. A label applicator for applying individual labels from a strip to an article at a labelling position, said label applicator comprising:

A. a stripper plate having a knife edge that is displaced from the labelling position, B. means for advancing the strip carrying the labels spaced along the strip over the knife edge so that the labels separate from the strip at the knife edge, C. a reciprocal pressure foot spaced opposite from the stripper plate knife edge and mounted to the applicator for reciprocal motion and for arcuate motion, D. means for swinging the pressure foot simultaneously with the operation of said strip advancing means from a first position at which the axis of reciprocation intersects the labelling position toward the stripper plate to a second position wherein a portion of the foot overlies the stripper plate and is cocked so that the leading edge of each separating label engages the foot at an angle whereby the label is positioned accurately laterally relative to the foot, E. means for temporarily adhering the label to the pressure foot, F. means for stopping said strip advance and simultaneously for returning the pressure foot to its first position, G. means for reciprocating the pressure foot in its first position so that the foot extends momentarily and presses the label against an article placed in its path at the labelling position, and H. means for producing first, second and third signals in sequence during a labelling operation, the first signal causing the reciprocating means to extend the pressure foot and apply to the article a label that was obtained during a previous labelling operation and the second and third signals energizing, respectively, the swing means and the stopping means whereby the applicator retrieves a label for a next labelling operation.

2. The applicator defined in claim 1 wherein the pressure foot comprises

A. a flexible, resilient body having at least one generally flat outer surface for receiving a label from the strip, and B. means defining a cavity in the body so that when the pressure foot presses a label against a rounded article, said foot surface is deformed into the cavity to conform to the article whereby edge margins of said surface are drawn toward one another so that pressure is applied to the edges of the label at the sides of the rounded article.

3. The applicator defined in claim 2 and further including

A. one or more passages extending into the foot from said surface and communicating with said cavity, and B. means for drawing a vacuum in said cavity so that a label placed against said surface is held there by air pressure.

4. The applicator defined in claim 3 wherein

A. the pressure foot is a generally rectangular block, said surface constituting one outside wall of the block, and B. the cavity is a generally cylindrical bore extending through the block adjacent said outside wall with its axis being parallel to said outside wall.

5. The applicator defined in claim 1 wherein the reciprocating means comprise

A. a piston, and

B. means for actuating the piston to extend the pressure foot momentarily toward an article placed at the work station.

6. The applicator defined in claim 5

A. wherein the swinging means comprise (1) a shaft connected to the piston and mounted for pivotal movement, and (2) means for pivoting the shaft when a portion of the strip underlying the label is advanced over the knife edge so that the pressure foot swings over to meet the separating label, B. wherein the returning means comprise a label edge detector positioned adjacent the path of the labels on the strip, and C. means for rotating said shaft in the opposite direction when the detector senses the edge of an advancing label.

7. The applicator defined in claim 6 wherein the detector comprises

A. a coil,

B. a pin-like permanent magnet positioned inside the coil and shiftable parallel to the coil axis, and C. means for positioning the coil and magnet so that an end of the magnet rides along the tops of the advancing labels so that when a label edge encounters the magnet, it shifts the magnet along said axis so as to induce a current pulse in the coil, and D. means for applying the current pulse to actuate the opposite direction turning means.

* * * * *

UNITED STATES PATENT AND TRADEMARK OFFICE

CERTIFICATE OF CORRECTION

PATENT NO. : 4,132,583

DATED : January 2, 1979

INVENTOR(S) : William S. Hodgson

It is certified that error appears in the above-identified patent and that said Letters Patent are hereby corrected as shown below:

Col. 1, line 12, "is" should be --in--.

Col. 7, line 17, "one" should be --on--.

Col. 8, line 69, "reading" should be --readying--.

Col. 10, line 7, "applies" should be --applied--.

Col. 10, line 7, "first" should be --flat--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*